United States Patent [19]

Ortwein

[11] Patent Number: 4,775,103

[45] Date of Patent: Oct. 4, 1988

[54] ELASTICALLY MOUNTED RAILS FOR VEHICLE TRACKS

[76] Inventor: Hermann Ortwein, Niehler Kirchweg 155, D-500 Köln 60, Fed. Rep. of Germany

[21] Appl. No.: 930,808

[22] Filed: Nov. 13, 1986

[30] Foreign Application Priority Data

Nov. 13, 1985 [DE] Fed. Rep. of Germany ..... 3540128

[51] Int. Cl.[4] ..... E01B 9/62

[52] U.S. Cl. ..... 238/283; 238/149; 238/336; 238/382

[58] Field of Search ..... 238/130, 149, 264, 267, 238/275, 276, 283, 292, 293, 306, 307, 122, 336, 129, 382, 2, 8

[56] References Cited

U.S. PATENT DOCUMENTS

| | | | |
|---|---|---|---|
| 208,880 | 10/1878 | Atwood | 238/283 |
| 382,803 | 5/1888 | Fackenthall et al. | 238/283 |
| 896,985 | 8/1908 | Gathmann | 238/149 |
| 1,114,369 | 10/1914 | Kukla | 238/149 |
| 2,670,136 | 2/1954 | Moses | 238/382 X |
| 2,763,586 | 9/1956 | Noyes | 238/283 |
| 3,383,043 | 5/1968 | Tew | 238/283 |
| 3,417,922 | 12/1968 | Dargier De Saint Vaulry | 238/264 X |
| 3,525,472 | 8/1970 | Sato | 238/382 X |
| 4,175,700 | 11/1979 | Gehrke | 238/304 X |
| 4,266,719 | 5/1981 | Ortwein et al. | 238/382 X |

FOREIGN PATENT DOCUMENTS

| | | | |
|---|---|---|---|
| 0840099 | 5/1952 | Fed. Rep. of Germany | 238/283 |

*Primary Examiner*—Robert B. Reeves
*Assistant Examiner*—Scott H. Werny
*Attorney, Agent, or Firm*—Herbert Dubno; Andrew Wilford

[57] ABSTRACT

A sound-damping rail assembly for a track for rail vehicles comprises a rail having a pair of downwardly converging flanks below its head and above its base. The rail is received in a frame with downwardly inclined sides, the flanks being braced against these sides by elastomeric layers which are interposed between the flanks and the sides. A further elastic layer can be provided between the base or foot of the rail and the inner supporting surface of the frame and such layers may completely envelop the rail except for the head.

11 Claims, 2 Drawing Sheets

ELASTICALLY MOUNTED RAILS FOR VEHICLE TRACKS

CROSS REFERENCE TO RELATED APPLICATIONS

The present application is related to my copending application Ser. Nos. 832,513 filed Feb. 21, 1986 and 754,029 filed July 11, 1985. Reference may also be had to the following U.S. patents in which I am named as an inventor alone or with another:

U.S. Pat. Nos. 4,527,736 issued July 9, 1985, 4,577,801 issued Mar. 25, 1986, and 4,266,719 issued May 12, 1981.

FIELD OF THE INVENTION

My present invention relates to elastically mounted rail assemblies for tracks for vehicles, generically identified as rail vehicles, and including, for example, surface rail lines, railroad lines, trolley lines, subway lines and the like.

BACKGROUND OF THE INVENTION

In recent years, particularly with the advent of high-speed rail travel, it has become increasingly important to elastically mount the rails of a rail vehicle system and thereby provide shock and acoustic damping between the rail and the bed or foundation.

It is known, for example to provide an elastic mount below the base or foot of the rail in the form of an elastic pad or layer.

In practice it is found that such elastic beds provide little or no acoustic damping.

It is customary to provide beneath the rail-supporting sleepers or ties, metal plates supported by sound-damping mounts. With such mounts, the rails bear directly upon the sleepers while the sleepers transmit force via inclined peripherally located elastic layers to the mount frame which is connected to the foundation or underlying bed structure (German open application No. 28 28 713).

Such mounts have been found to be highly effective for sound-damping purposes although they are not applicable to all locations, i.e. cannot be installed in a universal manner at all sites at which sound damping is required. The problem in some locations is that there may be a lack of available space in which to accommodate such mounts. This is particularly the case in so-called street railways and in tunnels where space for accommodating any mounting structure for the rails is at a premium.

OBJECTS OF THE INVENTION

It is the principal object of the present invention to provide an improved elastic rail mounting assembly which obviates the above-mentioned drawback and can be accommodated where space is at a premium.

Another object of my invention is to provide an elastically mounted rail arrangement which has highly effective sound damping not only for air-transmitted sound or noise, but for the body-transmitted sound or noise which normally propagates from a rail used in a track.

Still another object of the invention is to provide an assembly for the purposes described which can be used where little space is available and which is effective both for so-called street railways and in tunnels for subterranean rail lines and the like.

SUMMARY OF THE INVENTION

These objects and others which will become apparent hereinafter are attained, in accordance with the invention with a rail assembly in which the rail itself is elastically mounted in a frame directly utilizing elastic layers above the base or foot of the rail and interposed directly between the rail and the sides of the frame flanking the rail above the base thereof.

According to the invention, the rail comprises the aforementioned base or foot, a head upon which the rail vehicle wheel is adapted to ride and a web supporting this head on the base, the web extending upward from the base.

According to the invention, below the rail head, the rail is provided with downwardly converging flanks terminating in a narrow portion or neck, the converging flanks being juxtaposed but spaced from a pair of downwardly converging sides of the aforementioned frame and being braced against these sides of the frame by elastic layers filling the space between each rail flank and the corresponding frame side, the layers thus also converging downward toward one another.

With the arrangement of the invention, the elastically mounted assembly has an overall height which is only slightly greater than the head of the rail itself, e.g. by the thickness of any flange portion or element of the frame underlying the base of the rail and any elastic layer which can preferably be interposed between the base of the rail and the underlying portion of the frame.

The rail assembly of the invention can be utilized particularly neatly in track arrangements with or without ballast, in which the top of the track lies practically at the level of the surrounding portion of the bed or projects only slightly above it.

Investigations have shown that where the rail is enveloped on all sides with practically the only exception being its upper surface, the wear of the rail and of the wheels riding thereon is significantly reduced by comparison with other track systems. Furthermore, there is a reduced tendency for the formation of corrugations on the running surface of the rail. The clamps hitherto required for fastening the rail need no longer be used, particularly where the frame is formed by a concrete bed or is embedded in concrete, e.g. in the case of a street railway or the like.

As noted, in a preferred construction of the invention between the foot or base of the rail and the inner surface of the frame underlying the rail, there is positioned a further elastic intermediate layer. This layer is provided so that a progressive resistance to compression in response to increased loading of the rail will result and there will be no direct contact between the rails and the inner load-bearing surfaces of the frame.

Advantageously, the rail, except for the rail head, is completely enveloped by elastic intermediate layers, thus achieving not only improved acoustic damping, but also providing electrical insulation of the rail.

According to another feature of the invention, the angle of convergence of the aforementioned flanks of the rail is less than the angle of convergence of the sides of the frame, so that gaps containing the elastic layers bridging each flank and the respective side, likewise converge downward as do the elastic layers in thickness.

According to yet another feature of the invention, the elastic layer underlying the base or foot of the rail defines with the underlying inner surface of the frame at least one cavity whose height and cross section are so dimensioned that they are only filled by compression of this elastic layer when the normal load on the rail, corresponding to the passage of normal loaded rail vehicles, is exceeded.

The normal loading generally will amount to 70 to 80% of the full load at which the cavity or cavities can be completely filled by such compression.

This allows the resilient mounting of the rail for empty to normally loaded rail vehicles to be comparatively soft, while with higher than normal loading the resilient mounting rapidly increases in stiffness or hardness. This ensures with low to normal loaded vehicles an optimal sound damping at the rail.

In order to prevent migration of the elastic layers which are composed preferably of an elastomeric material such as rubber, I have found it to be advantageous to include in such layers, inlays or reinforcements of metal, fabric or the like. The reinforcements may be webs of metal or fabric or textile or metal strands arrayed parallel to one another.

The elastic layers are preferably so dimensioned that even in the case of unloaded rails, they are under a pretension.

While the inclined flanks can be formed unitarily with the head, web and base during the rolling of the rail, the invention is also applicable to standard rails. When standard rails are used, respective shaped elements are disposed against the web of the rail below the head and have the aforementioned flanks. Inwardly turned surfaces of these elements conform to the configurations of the web and head in the regions thereof abutting these elements of the standard rail.

The web of the rail can have parallel surfaces against which the shaped elements lie and these shaped elements can extend over the entire height of such a standard rail. Assembly of the elastically mounted rail arrangement can be effected easily if the frame is constituted from two frame halves which are clamped together by bolts which can traverse the web of the rail.

Where two frame halves are provided, the feet or base flanges of these frame halves may meet along longitudinal edges which can be beveled to define an upwardly open wedge-shaped gap. By corresponding tightening of the bolts which hold the two halves together, the desired degree of prestress on the elastic layers can be established with a high degree of precision.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
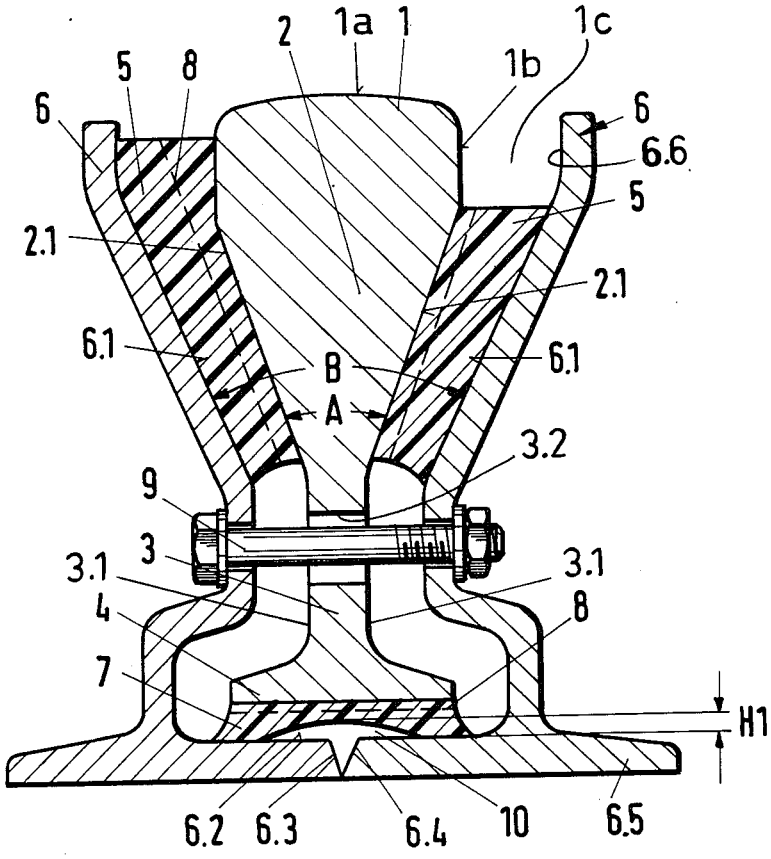
FIG. 1 is a vertical section through a rail assembly embodying the invention and using a rail having a special shape according to the invention.

In FIG. 1 the rail is shown to have a head 1 with a running surface 1*a* exposed at the top of the assembly and a lateral flank 1*b* along which the flange of a rail-vehicle wheel can ride in the channel 1*c* alongside the rail.

Below the rail head 1, the rail is unitarily formed, e.g. by rolling, with a downwardly tapering portion 2 which terminates at its narrowest part at a web 3 whose lateral faces 3.1 are mutually parallel. The web merges into a base or foot 4.

The flanks 2.1 of the downwardly tapering portion 2 are braced against elastic layers 5 which, in turn, are braced against a metal frame 6 which has a pair of downwardly converging lateral sides 6.1 juxtaposed with but spaced from the flanks 2.1.

The flanks 2.1 include an angle A between them while the sides 6.1 include an angle B between them which is greater than the angle A. Conversely stated, the angle A between the flanks 2.1 is less than the angle B between the sides 6.1.

At the upper ends, the sides 6.1 are extended at 6.6 with vertical portions reaching substantially to the top of the rail.

Figure 2:
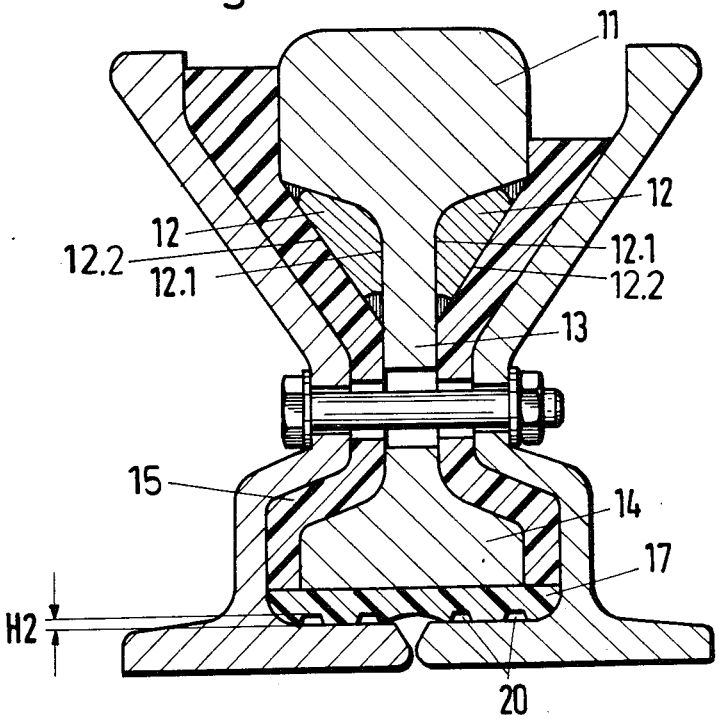
FIG. 2 is a similar view through a rail assembly utilizing a standard rail with a narrow base or foot.

Between the base 4 of the inner lower supporting surface 6.2 of the frame 6, I provide a further elastic layer 7. All of the elastic layers 5 and 7 are provided with respective inlays or reinforcements 8, e.g. of fabric, which are embedded in these elastomeric, e.g. rubber, layers. In the embodiments of FIGS. 1 and 2, the frame, e.g. the frame 6 of FIG. 1, is constituted of two mirror-symmetrical frame halves which are held together by bolts 9 traversing the web 3 through bores 3.2 therein passing the bolts with all around clearance. The bolts may be tightened to the extent necessary to provide the desired degree of prestress even when the rail is not under load upon the layers 5.

The abutment edges 6.3 of the base flange of the frame members are beveled and thus form an upwardly open wedge-shaped gap 6.4.

The outer portion 6.5 of these flanges serve to anchor the assembly to any bed as may be desired.

Between the layer 7 below the base 4 and the inner surface 6.2 of the frame 6 a space or cavity 10 is provided with a height H1. This height is sufficient to maintain a soft spring support for the rail for lightly loaded to normally loaded rail vehicles passing over the track, but is such that, when an overload is applied, this cavity will be taken up by compression of the layer 7 and a stiffer spring action will be generated.

In the embodiment illustrated in FIG. 2, the rail head 11 and the web 13 correspond to those of a standard rail with a narrow base 14. Below the rail head 11, elements 12 are mounted, e.g. by welding, to form the downwardly converging flanks 12.2. The inner surfaces 12.1 of the shaped elements 12 in contact with the web and the head, of course, conform to the contours of the latter.

Otherwise the principles of this assembly are the same as those previously discussed except that here the elastic intermediate layer 15 reaches to the layer 17 underlying the base 14 so that the layers 15 and 17 completely enclose or envelope the rail except for the region of the head thereof.

Furthermore, the layer 17 differs somewhat from the layer 7 previously described in that it is formed with a multiplicity of cavities 20 of a height H2 such that a soft spring action is provided for the rail in loads up to normal loads, but these cavities are filled by compression of the layer 17 to provide a stiffer action for higher than normal rail vehicle loads.

Figure 3:
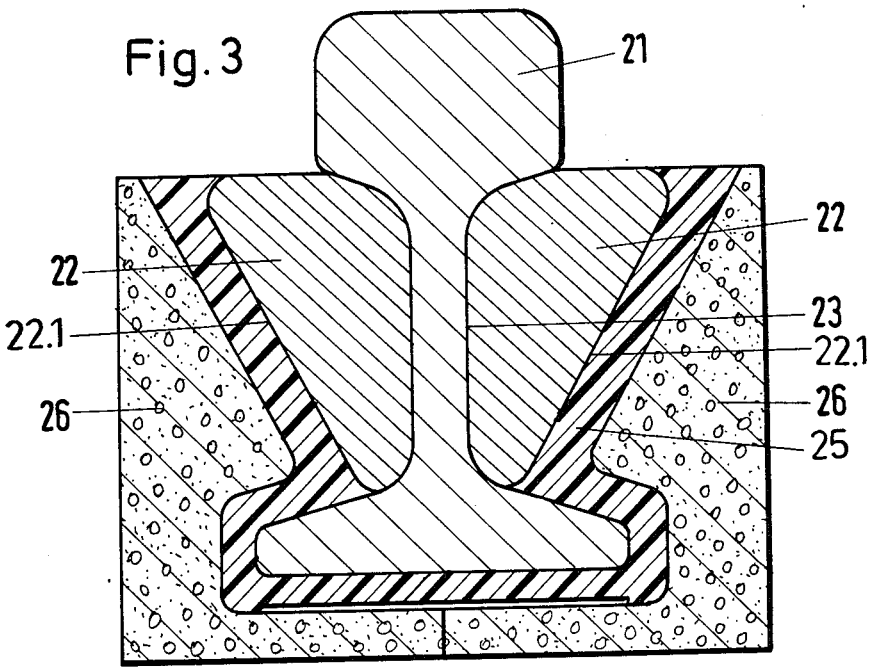
FIG. 3 is a vertical section through an assembly according to the invention in which the frame is cast in concrete and a standard wide-base rail is used.

FIG. 3 shows the use of a standard rail with a single elastic layer 25 enveloping the rail beneath the head and interposed between concrete frame-forming members 26. Here the established elements 22 which define the downwardly inclined flanks 22.1 extend the full height of the web 23 below the head 21 of the rail.

All of the rail assemblies described can be embedded so that the upper ends of the frame members lie flush with the top of the track bed or street for tunnel or street railways.

What is claimed is:

1. A sound-damping rail assembly for a track along which a vechicle can ride, said rail assembly comprising:

a rail having a base, a web extending upward from said base, a head supported on said web and having an upper surface along which a vehicle wheel can ride, and a region below said head and above said base of downwardly tapering cross section and hacing a pair of straight-line downwardly converging flanks defining an included flank angle;

a frame enclosing bottom and side regions of said rail and formed with a pair of sides spacedly juxaposed with said flanks, forming an included side angle greater than the flank angle, and converging straight-line downwardly, and an upwardly directed support surface spacedly juxaposed with the base;

a base elastic layer interposed and bridging the space between the support surface and the base; and respective side elastic layers interposed and bridging the spaces between each of said sides of said frame and the respective flanks.

2. The sound-damping rail assembly defined in claim 1 wherein said base elastic layer contains a reinforcement embedded in elastomer of said base elastic layer.

3. The sound-damping rail assembly defined in claim 1 wherein said elastic layers each contain a respective reinforcement embedded in elastomer of the respective elastic layer.

4. The sound-damping rail assembly defined in claim 3 wherein said layers are under prestress even when said rail is not under load.

5. The sound-damping rail assembly defined in claim 1 wherein said flanks are formed on respective shaped elements disposed against said web below said head and having inwardly turned surfaces conforming to the configurations of the web and head in regions thereof contacted by said elements.

6. The sound-damping rail assembly defined in claim 5 wherein said web has substantially parallel lateral faces against which said elements lie.

7. The sound-damping rail assembly defined in claim 6 wherein said elements extend substantially the full height of the web.

8. The sound-damping rail assembly defined in claim 1 wherein said frame is formed from two symmetrical frame halves interconnected by bolts traversing said web.

9. The sound-damping rail assembly defined in claim 8 wherein said frame halves are formed with base flanges underlying the base of said rail and having adjoining edges which are beveled to define an upwardly widening groove.

10. The sound-damping rail assembly defined in claim 1 wherein said frame sides have vertical upper ends reaching substantially to the level of the top of said head.

11. A sound-damping rail assembly for a track along which a vehicle can ride, the rail assembly comprising:

a rail having a base, a web extending upward from the base, a head supported on the web and having an upper surface along which a vehicle wheel can ride, and a region below the head and above the base of downwardly tapering cross section and having a pair of straight-line downwardly converging flanks defining an included flank angle;

a frame enclosing bottom and side regions of the rail and formed with a pair of sides spacedly juxaposed with the flanks, forming an included side angle greater than the flank angle, and converging straight-line downwardly, and an upwardly directed support surface spacedly juxaposed with the base;

a base elastic layer interposed and bridging the space between the support surface and the base, the base elastic layer defining with said frame member a cavity of a predetermined height and cross section and the base layer being of such elasticity that, only when the rail is subjected to a load in excess of a normal load corresponding to a load applied by a normally loaded vehicle, the base elastic layer is compressed to fully fill said cavity; and respective side elastic layers interposed and bridging the spaces between each of the sides of the frame and the respective flanks.

* * * * *